US012343644B2

(12) United States Patent
Tsao

(10) Patent No.: US 12,343,644 B2
(45) Date of Patent: Jul. 1, 2025

(54) ROCK-CLIMBING PINBALL TABLE

(71) Applicant: Chung-Piao Tsao, Taipei (TW)

(72) Inventor: Chung-Piao Tsao, Taipei (TW)

( * ) Notice: Subject to any disclaimer, the term of this patent is extended or adjusted under 35 U.S.C. 154(b) by 565 days.

(21) Appl. No.: 17/865,414

(22) Filed: Jul. 15, 2022

(65) Prior Publication Data

US 2024/0017160 A1 Jan. 18, 2024

(51) Int. Cl.
*A63F 7/02* (2006.01)

(52) U.S. Cl.
CPC ..... *A63F 7/025* (2013.01)

(58) Field of Classification Search
CPC .... A63F 7/02; A63F 7/025; A63F 7/28; A63F 7/30; A63F 2250/12; A63F 2250/127; A63F 2250/128; A63F 7/00; A63F 7/22; A63F 7/24; A63F 7/34; A63F 7/36; A63F 2007/3005; A63F 2007/3015; A63F 9/08; A63F 9/26
See application file for complete search history.

(56) References Cited

U.S. PATENT DOCUMENTS 1,565,525 A * 12/1925 Tatosian ..... A63F 7/02 273/120 R
2,237,986 A * 4/1941 Gilford ..... A63F 7/00 273/335
4,248,427 A * 2/1981 Vierimaa ..... A63F 7/04 273/125 R
4,333,655 A * 6/1982 Rudell ..... A63F 3/00148 273/287
5,295,693 A * 3/1994 Dobson ..... A63F 7/00 273/108
10,322,335 B1 * 6/2019 Krieman ..... A63F 7/34
2024/0017160 A1 * 1/2024 Tsao ..... A63F 7/28

FOREIGN PATENT DOCUMENTS

WO WO-2023248011 A2 * 12/2023 ..... A63F 9/0252

* cited by examiner

*Primary Examiner* — Raleigh W Chiu
(74) *Attorney, Agent, or Firm* — Leong C. Lei

(57) ABSTRACT

A rock climbing pinball table includes: a back plate, first side plate, front plate and second side plate, combined with each other one by one to form a hollow polygonal box, tops of the first side plate and second side plate respectively provided with a first through hole and third through hole, a top of the front plate spaced with a plurality of first through holes, and the front plate provided with a plurality of first penetrating holes at intervals; and a hanging unit, including a rope and bearing element, a center of the rope combined with the bearing element, the both ends of the rope respectively passed through each of the second through holes and respectively extended out of the first through hole and third through hole, and the bearing element provided with an accommodating space providing for placing a pinball.

4 Claims, 4 Drawing Sheets

ROCK-CLIMBING PINBALL TABLE

TECHNICAL FIELD OF THE INVENTION

The present invention relates to a pinball game device, and more particularly to a hand-operated rock-climbing pinball table.

DESCRIPTION OF THE PRIOR ART

Most of the pinball tables on the market only use one hand to operate, pull the handle with one hand, and use the principle of elasticity to eject the pinballs, and the other is to press the buttons with both hands to drive the striker to eject the pinballs.

The above conventional pinball tables have been used for a long time, lack of gaining entertainment.

SUMMARY OF THE INVENTION

To overcome the above disadvantage, and to increase the functionality, the present invention is provided to increase the use of both hands and the play design concept, hoping to increase concentration and hand-eye coordination flexibility through this design, thereby achieving rehabilitation effects and increasing entertainment.

The present invention proposes a rock-climbing pinball table, including: a back plate, first side plate, front plate and second side plate, combined with each other one by one to form a hollow polygonal box, tops of the first side plate and second side plate respectively provided with a first through hole and third through hole, a top of the front plate spaced with a plurality of second through holes, and the front plate provided with a plurality of first penetrating holes at intervals; and a hanging unit, including a rope and bearing element, a center of the rope combined with the bearing element, the both ends of the rope respectively passed through each of the second through holes and respectively extended out of the first through hole and third through hole, and the bearing element provided with an accommodating space providing for placing a pinball. When the present invention is used, the bearing element is moved by pulling the both ends of the rope, allowing the pinball to pass between each two adjacent first penetrating holes, thereby achieving the game purpose. If the pinball drops into any one of the first penetrating holes, the game fails.

DETAILED DESCRIPTION OF THE PREFERRED EMBODIMENTS

In order to facilitate the description of the content of the present invention and the effects that can be achieved, the specific embodiments are listed hereby in conjunction with the drawings.

Figure 1:
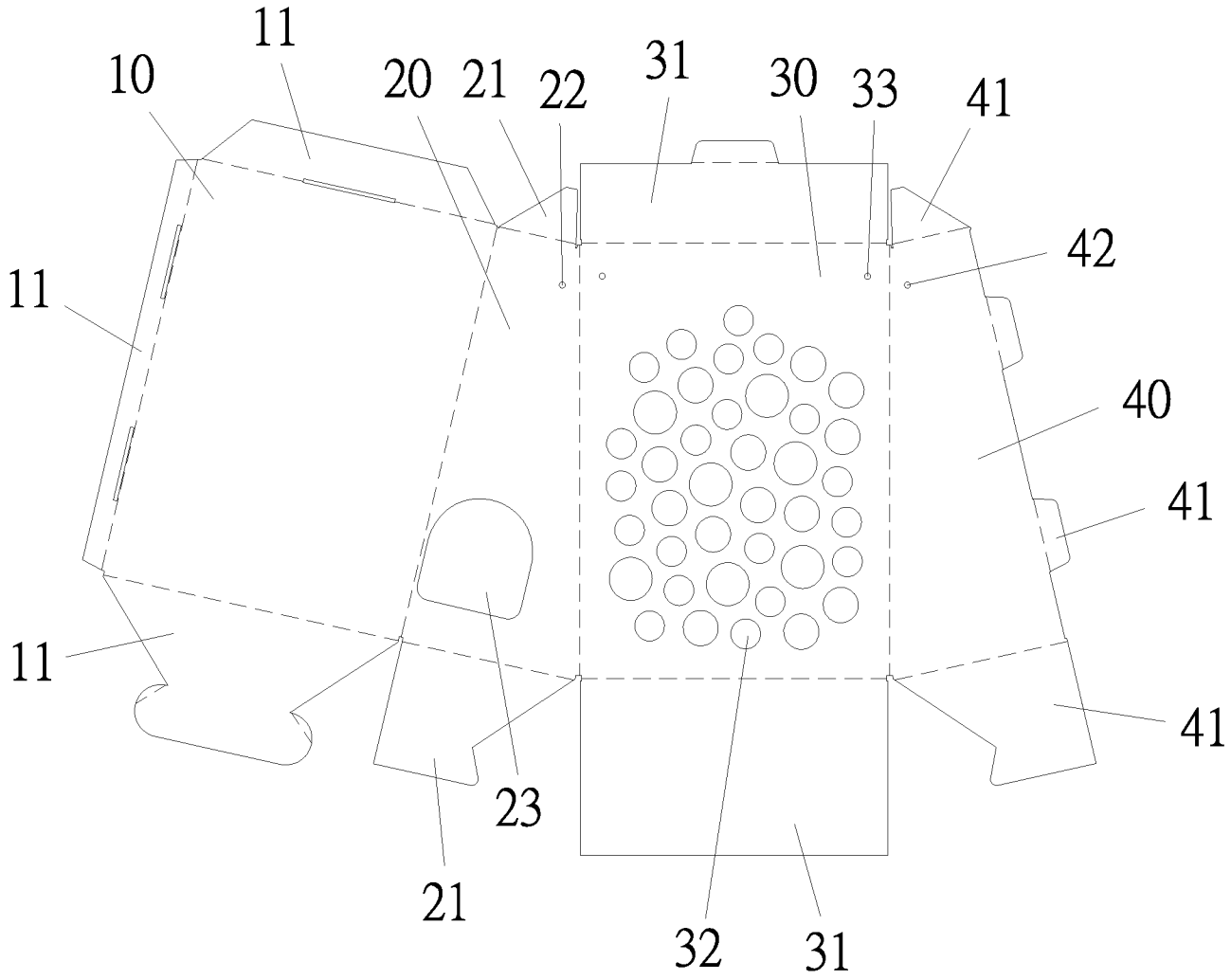
FIG. 1 is a schematic view of the plane expansion of the present invention.
Figure 2:
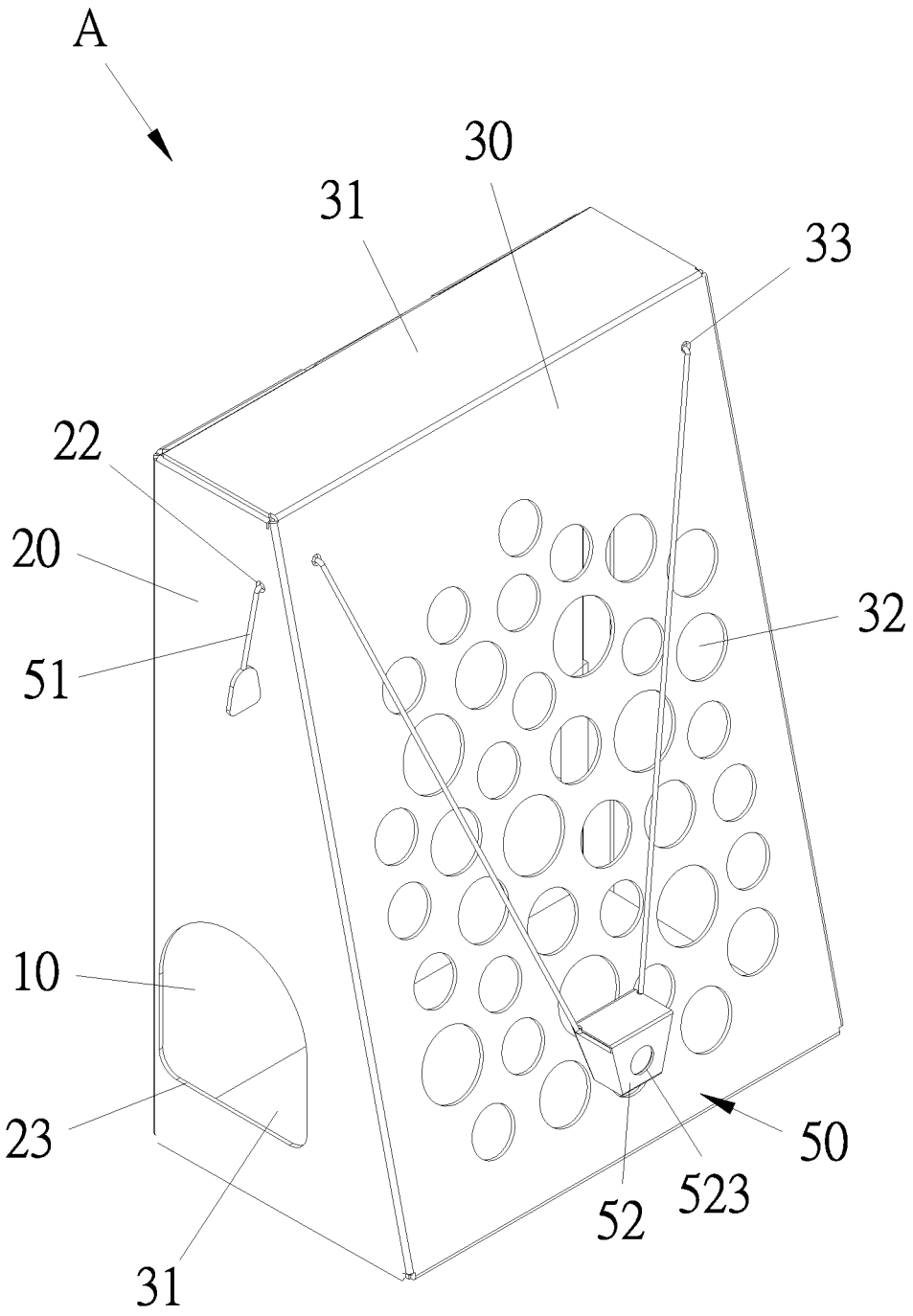
FIG. 2 is a perspective view of the present invention.

Referring to FIGS. 1 and 2, a rock-climbing pinball table of the present invention includes a back plate 10, first side plate 20, front plate 30, second side plate 40, and hanging unit 50.

The top end, bottom end and one side of the back plate 10 are respectively extended with a first joint 11.

The top end and bottom end of the first side plate 20 are respectively extended with a second joint 21, and the one side of the first side plate 20 is connected with another side of the back plate 10, with the top of the first side plate 20 being provided with a first through hole 22.

The top end and bottom end of the front plate 30 are respectively extended with a third joint 31; one side of the front plate 30 is connected with another side of the first side plate; the front plate 30 is provided with a plurality of first penetrating holes 32 at intervals; the top of the front plate 30 is spaced with two second through holes 33; and the first through hole 22 is adjacent to the front plate 30, where the second through holes 33 each is higher than the first through hole 22.

The top end, bottom end and one side of the second side plate 40 are respectively extended with a fourth joint 41; one side of the second side plate 40 is connected with another side of the front plate 30; the top of the second side plate 40 is provided with a through hole 42 adjacent to the front plate 30; the second through holes 33 each is higher than the third hole 42; the connections between the back plate 10 and first side plate 20, between the first side plate 20 and front plate 30 and between the front plate 30 and second side plate 40 are respectively bended; and the first joints 11 each is respectively combined with each of the second joints 21, each of the third joints 31 and each of the fourth joints 41, thereby forming a hollow polygonal box A, where the first side plate 20 or second side plate 40 is provided with a third penetrating hole 23.

The first joint 11 on the bottom of the back plate 10 and the third joint 31 on the bottom end of the front plate 30 are wider than the first joint 11 on the top end of the back plate 10 and the third joint 31 on the top end of the front plate 30, and the first side plate 20 and second side plate 40 respectively are a right-angled trapezoid, allowing the front plate 30 of the box A to be inclined.

Figure 3:
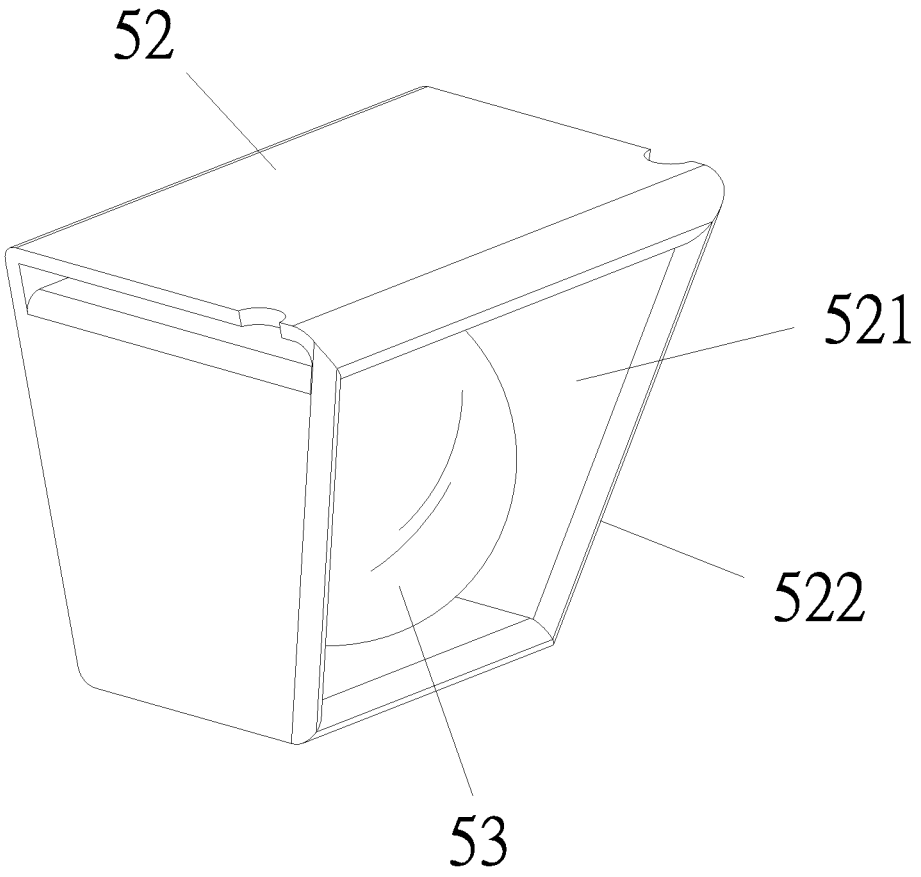
FIG. 3 is a perspective view of a bearing element of the present invention.

Referring to FIGS. 2 and 3, a hanging unit 50 includes a rope 51 and bearing element 52, where the center of the rope 51 is coupled to the bearing element 52, and the both ends of the rope 51 are respectively passed through each of the second through holes 33 and respectively extended out of the first through hole 22 and third through hole 42. The bearing element 52 is provided with an accommodating space 521 and an opening 522 in communication with the accommodating space 521; one face of the bearing element 52 provided with the opening 522 is inclined, where the bearing element 52 is abutted against the front plate 30 with the face that the opening 522 is inclined.

One face of the bearing element 52 opposite to the opening 522 is provided with a second penetrating hole 523, and the pinball 53 is convenient to be observed and the weight of the bearing element 52 can be reduced through the second penetrating hole 523.

Figure 4:
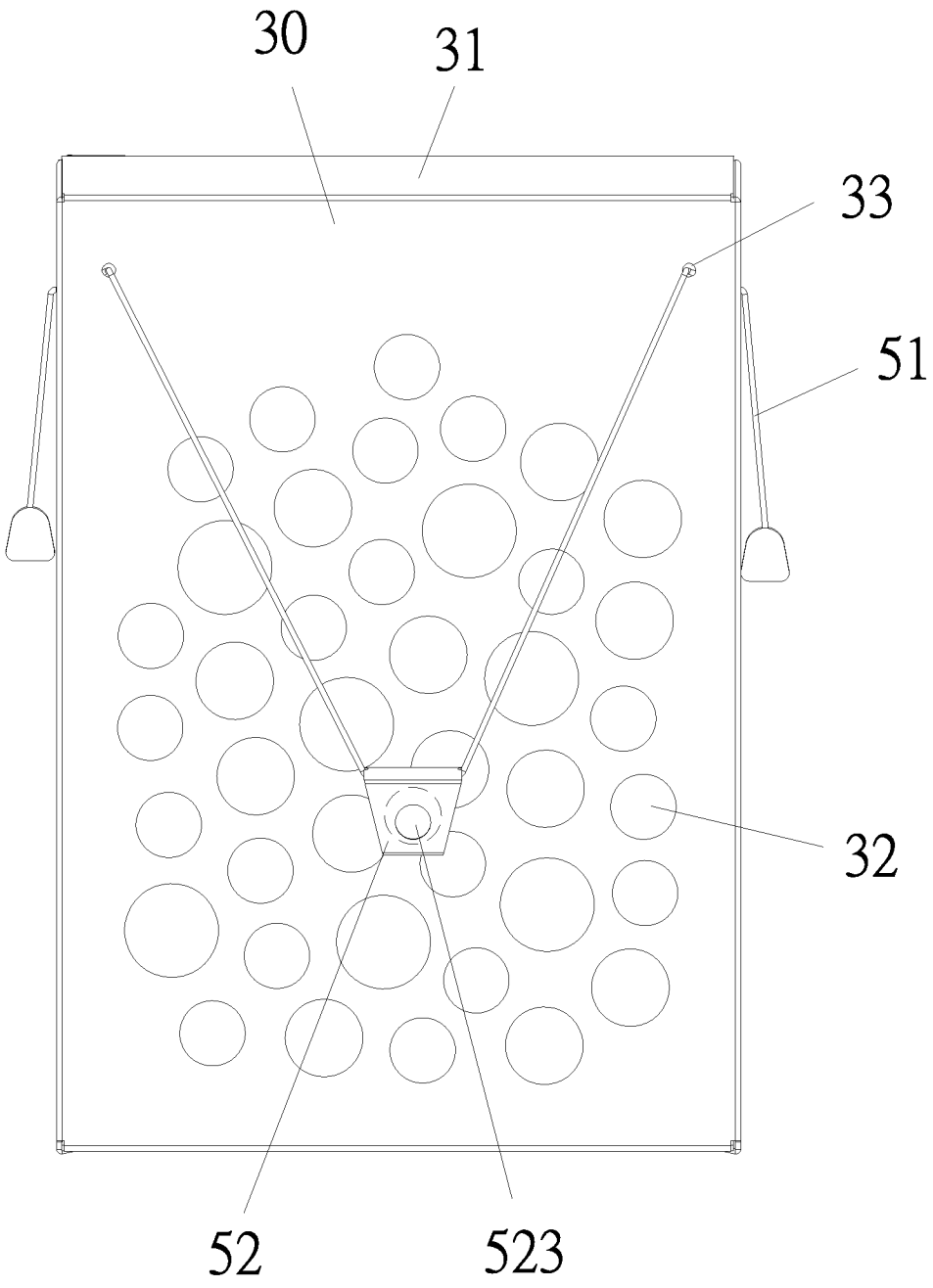
FIG. 4 is a schematic view of the present invention in a use state.

Referring to FIG. 4, the use manner of the present invention is that the accommodating space 521 provides for placing one pinball 53, the bearing element 52 is moved by pulling the both ends of the rope 51 to make the pinball 53 pass the two adjacent first penetrating holes 32, thereby achieving the game purpose. If the pinball 53 drops into any one of the first penetrating holes 32, the gain challenge fails, and the pin ball 53 is taken out from the third penetrating hole 23 to repeat the game.

I claim:

1. A rock-climbing pinball table, comprising:

a back plate, a top end, bottom end and one side thereof respectively extended with a first joint;

a first side plate, a top end and bottom end thereof respectively extended with a second joint, one side of said first side plate in connection with another side of said back plate, and a top of said first side plate provided with a first through hole;

a front plate, a top end and bottom end thereof respectively extended with a third joint, one side of said front plate in connection with another side of said first side plate, said front plate provided with a plurality of first penetrating holes at intervals, a top of said front plate spaced with two second through holes, said first through hole adjacent to said front plate, and said second through holes each being higher than said first through hole;

a second side plate, a top end, bottom end and one side thereof respectively extended with a fourth joint, one side of said second side plate in connection with another side of said front plate, a top of said second side plate provided with a third through hole adjacent to said front plate, said second through holes each higher than said third through hole, the connections between said back plate and first side plate, between said first side plate and front plate, and between said front plate and second side plate are bent, and said first joints each respectively in combination with each of said second joints, each of said third joints and each of said fourth joints to form a hollow polygon; and a hanging unit, comprising a rope and bearing element, a center of said rope in combination with said bearing element, both ends of said rope respectively passed through each of said second through holes, and respectively extended out of said first through hole and third through hole, said bearing element provided with an accommodating space and opening in communication with said accommodating space, said accommodating space providing for placing a pinball, said bearing element moved by pulling both ends of said rope, allowing said pinball to pass between each said two adjacent first penetrating holes.

2. The table according to claim 1, wherein said first joint on said bottom end of said back plate and said third joint on said bottom end of said front plate are wider than said first joint on said top end of said back plate and said third joint on said top end of said front plate, and said first side plate and second side plate respectively are a right-angled trapezoid, allowing said front plate to be inclined, one face of said bearing element provided with said opening is inclined, and said bearing element abutted against said front plate with said face provided with said opening.

3. The table according to claim 2, wherein said bearing element is provided with a second penetrating hole opposite to said face provided with said opening.

4. The table according to claim 1, wherein said first side plate or second side plate is provided with a second penetrating hole.

* * * * *